US007914219B2

(12) United States Patent
Harris

(10) Patent No.: US 7,914,219 B2
(45) Date of Patent: Mar. 29, 2011

(54) APPARATUS AND METHOD FOR MOVING A COVER

(75) Inventor: Richard Hunter Harris, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 663 days.

(21) Appl. No.: 11/938,397

(22) Filed: Nov. 12, 2007

(65) Prior Publication Data

US 2009/0123210 A1 May 14, 2009

(51) Int. Cl.
*B41J 29/13* (2006.01)

(52) U.S. Cl. ..... 400/693; 400/719

(58) Field of Classification Search ..... 400/693, 400/719; 16/277, 278, 280, 281, 289, 290, 16/291, 292, 293, 297, 298, 304, 305, 306
See application file for complete search history.

(56) References Cited

U.S. PATENT DOCUMENTS

| | | | | |
|---|---|---|---|---|
| 270,368 | A | 1/1883 | Barlow | |
| 768,718 | A | 8/1904 | Austin | |
| 1,010,071 | A | 11/1911 | Potter | |
| 1,106,640 | A | 8/1914 | Eccleston | |
| 1,350,134 | A | 8/1920 | Bellican | |
| 1,354,196 | A | 9/1920 | Kalton | |
| 1,367,414 | A | 2/1921 | Matlick | |
| 1,508,524 | A | 9/1924 | Olson | |
| 1,811,653 | A | 6/1931 | Schwartz et al. | |
| 2,024,919 | A | 12/1935 | Fredricks et al. | |
| 2,520,921 | A * | 9/1950 | Foster | 16/401 |
| 3,287,757 | A | 11/1966 | Van Noord | |
| 6,715,813 | B2 * | 4/2004 | Thompson et al. | 296/1.02 |

FOREIGN PATENT DOCUMENTS

JP 2006312321 A * 11/2006

* cited by examiner

*Primary Examiner* — Daniel J Colilla
(74) *Attorney, Agent, or Firm* — Yee & Associates, P.C.; Jason O. Piche

(57) ABSTRACT

The illustrative embodiments described herein provide an apparatus and method for moving a cover. The apparatus includes a base. The apparatus also includes a cover pivotably coupled to the base. The apparatus also includes a set of flexible bands. A first end of each of the set of flexible bands is coupled to the cover. A second end of the set of flexible bands is coupled to the base. The set of flexible bands are adapted to bias the cover into an open position. When the cover is opened by a user, the set of helical springs are elongated when the cover is forced beyond its open position.

17 Claims, 5 Drawing Sheets

APPARATUS AND METHOD FOR MOVING A COVER

BACKGROUND OF THE INVENTION

1. Field of the Invention

The invention relates generally to a method and apparatus for moving a cover. More particularly, the present invention relates to a method and apparatus for moving a cover using a set of flexible bands.

2. Description of the Related Art

Covers may be used to partially or completely conceal components of various devices. Covers may also provide functionality to the device to which the cover is associated. In many cases, the cover is coupled to the device to which the cover is associated. For example, a cover may be a hood that is coupled to the exterior of an automobile. In this example, the hood may both conceal components of the automobile, such as the engine and radiator, and provide protection for those same components.

Many types of printers, such as point of sale printers, use covers to conceal printer components or to provide functionality for the printer. In one specific example, covers may be used to conceal one or more compartments of a printer, such as a compartment used to store paper that is used by the printer. In another example, a cover may both conceal printer components and provide functionality for the printer, such as acting as a paper feed tray.

Many printer covers are able to move relative to the printer. For example, a printer may include a lid that is pivotably attached to the printer. In this example, the lid may be lifted into an open position relative to an axis located at the pivot point such that a compartment, such as a paper supply compartment, is exposed when the cover is lifted.

Covers on point of sale printers may be particularly susceptible to abuse by users. Point of sale printers are often utilized in fast-paced environments, such as retail stores and other transaction centers. Thus, components associated with the point of sale printer, including covers, touch displays, and keyboards may experience excessive amounts of wear and tear. This problem is compounded for printer components or compartments that require access, such as hinged covers that must be opened to replenish paper for the printer.

One current method for opening a cover in a point of sale printer uses an assist spring that provides only an upward, or opening, force on the cover. This method often also includes a limiting mechanism that prevents the cover from begin opened past a certain point. However, the assist force provided by the springs in this current method expose the limiting mechanism to excessive wear. The limiting mechanism may be further subject to wear when a user, such as a sales associate or customer, provides additional force to the cover beyond that provided by the springs.

Another currently used method for opening a cover or pivotable component for any device is a "lock knee" system. In a lock knee system, two rigid rods, connected by a pivot point, may be used to support the cover or pivotable component. The cover or pivotable component may be moved into a closed position by pushing the pivot point, thereby allowing the two rigid rods to swing closer to one another about an axis defined by the pivot point. However, this current method also presents a pinching hazard and may be easily damaged, especially in an abusive environment, such as that experienced by point of sale printers.

Therefore, it would be advantageous to have an improved method and apparatus to move a cover that overcomes some or all above described problems as well as possibly other problems.

BRIEF SUMMARY OF THE INVENTION

The illustrative embodiments described herein provide an apparatus and method for moving a cover. The apparatus includes a base. The apparatus also includes a cover pivotably coupled to the base. The apparatus also includes a set of flexible bands. A first end of each of the set of flexible bands is coupled to the cover. A second end of the set of flexible bands is coupled to the base. The set of flexible bands are adapted to bias the cover into an open position.

BRIEF DESCRIPTION OF THE SEVERAL VIEWS OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
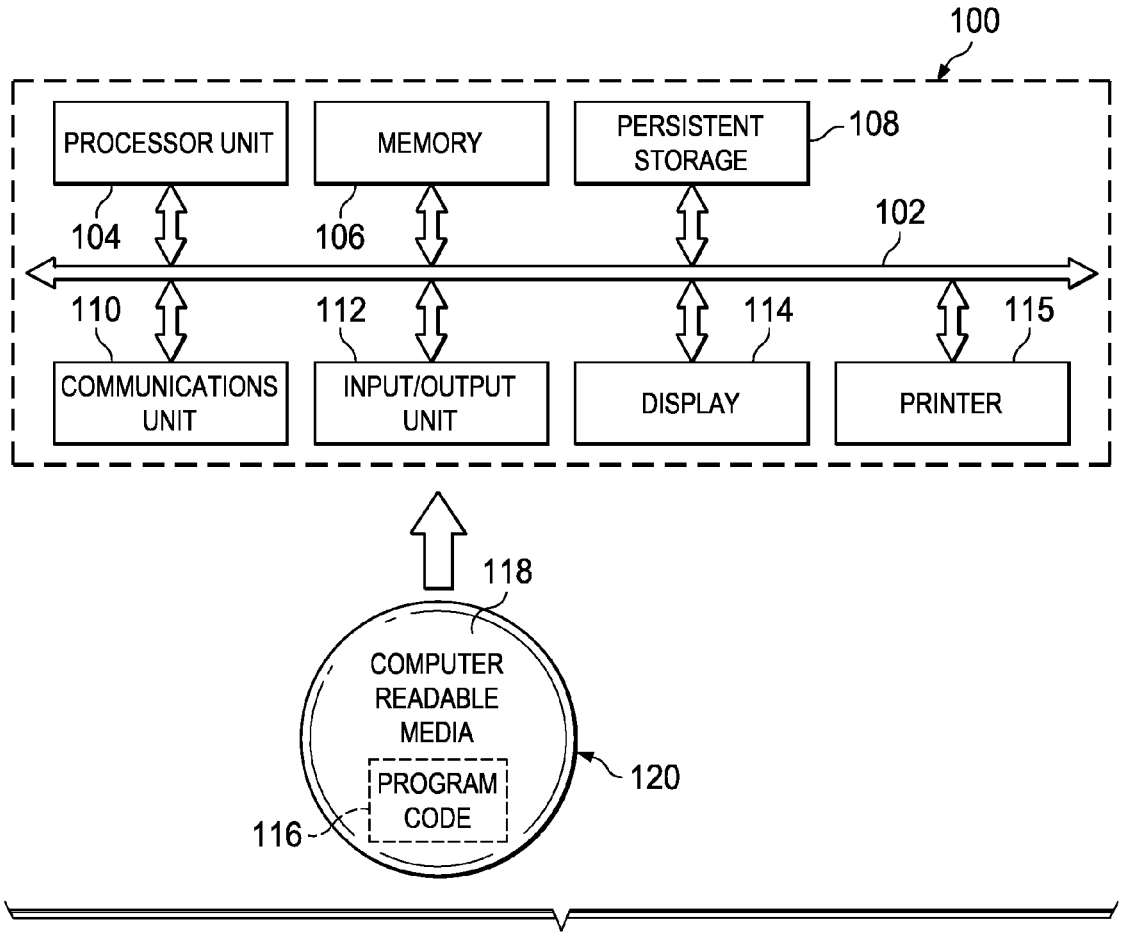
FIG. 1 is a block diagram of a data processing system in accordance with an illustrative embodiment of the present invention.

Turning now to FIG. 1, a block diagram of a data processing system is depicted in accordance with an illustrative embodiment of the present invention. In this illustrative example, data processing system 100 includes communications fabric 102, which provides communications between processor unit 104, memory 106, persistent storage 108, communications unit 110, input/output (I/O) unit 112, display 114, and printer 115.

Processor unit 104 serves to execute instructions for software that may be loaded into memory 106. Processor unit 104 may be a set of one or more processors or may be a multiprocessor core, depending on the particular implementation. Further, processor unit 104 may be implemented using one or more heterogeneous processor systems in which a main processor is present with secondary processors on a single chip. As another illustrative example, processor unit 104 may be a symmetric multi-processor system containing multiple processors of the same type.

Memory 106, in these examples, may be, for example, a random access memory. Persistent storage 108 may take various forms depending on the particular implementation. For example, persistent storage 108 may contain one or more components or devices. For example, persistent storage 108 may be a hard drive, a flash memory, a rewritable optical disk, a rewritable magnetic tape, or some combination of the above. The media used by persistent storage 108 also may be removable. For example, a removable hard drive may be used for persistent storage 108.

Communications unit 110, in these examples, provides for communications with other data processing systems or devices. In these examples, communications unit 110 is a network interface card. Communications unit 110 may provide communications through the use of either or both physical and wireless communications links.

Input/output unit 112 allows for input and output of data with other devices that may be connected to data processing system 100. For example, input/output unit 112 may provide a connection for user input through a keyboard and mouse. Further, input/output unit 112 may send output to printer 115. Display 114 provides a mechanism to display information to a user.

Instructions for the operating system and applications or programs are located on persistent storage 108. These instructions may be loaded into memory 106 for execution by processor unit 104. The processes of the different embodiments may be performed by processor unit 104 using computer implemented instructions, which may be located in a memory, such as memory 106. These instructions are referred to as, program code, computer usable program code, or computer readable program code that may be read and executed by a processor in processor unit 104. The program code in the different embodiments may be embodied on different physical or tangible computer readable media, such as memory 106 or persistent storage 108. In one embodiment, the program code relates to printing a receipt on printer 115 for transactions that occurs at a point of sale.

Printer 115 may be used to print any type of document. Instructions may be sent to printer 115 on communications fabric 102 to provide printer 115 with a set of parameters relating to the printing of one or more documents. These parameters may contain, for example, data that should be printed on a receipt to be printed by printer 115 at a point of sale. Also, because printer 115 is compatible with a variety of different operating systems, such as Microsoft® Windows or Unix, instructions may be sent to printer 115 regardless of the operating system executing on data processing system 100. Microsoft and Windows are trademarks of Microsoft Corporation in the United States, other countries, or both. Printer 115 may be connected to one or more of the other components of FIG. 1 via a direct connection, such as a bus, or over a network, such as the Internet.

Program code 116 is located in a functional form on computer readable media 118 and may be loaded onto or transferred to data processing system 100 for execution by processor unit 104. Program code 116 and computer readable media 118 form computer program product 120 in these examples.

The different components illustrated for data processing system 100 are not meant to provide architectural limitations to the manner in which different embodiments may be implemented. The different illustrative embodiments may be implemented in a data processing system including components in addition to or in place of those illustrated for data processing system 100. Other components shown in FIG. 1 can be varied from the illustrative examples shown.

Figure 2:
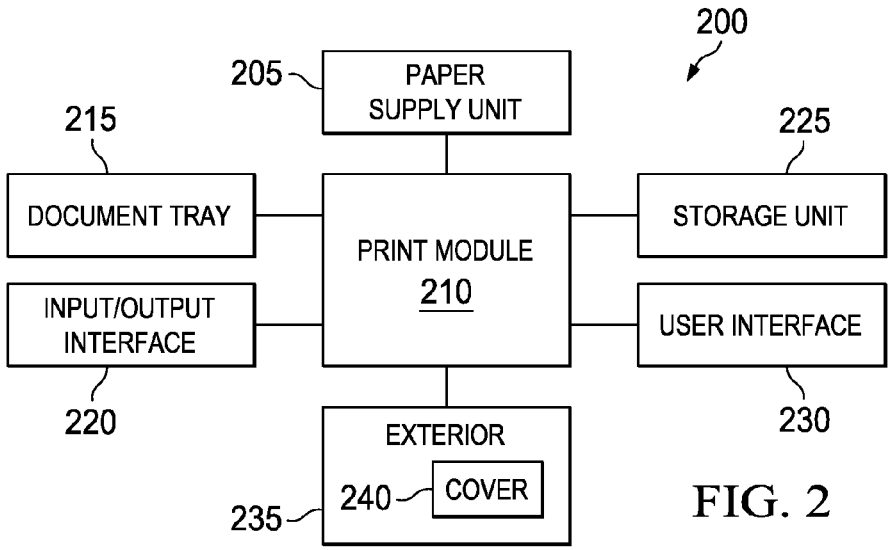
FIG. 2 is a block diagram of a printer in which the illustrative embodiments may be implemented.

Turning now to FIG. 2, a block diagram of a printer is depicted in which the illustrative embodiments may be implemented. Printer 200 is a non-limiting example of printer 115 in FIG. 1. In this illustrative example, printer 200 may be any type of printer, such as a thermal printer, toner-based printer, liquid inkjet printer, solid ink printer, dye-sublimation printer, inkless printer, impact printer, daisy wheel printer, dot-matrix printer, line printer, or a pen-based plotter. Printer 200 may be used in any type of application, such as a point of sale printer, an office printer, or a home-use printer. A point of sale printer is sometimes referred to as a fiscal printer.

Printer 200 includes paper supply unit 205. Paper supply unit 205 holds printable media that is used by printer 200 to print documents. The printable media in paper supply unit 205 may take a variety of forms, such as a roll of printable media or a stack of pre-cut sheets of printable media. The printable media may be made of any material that is capable of being printed on by printer 200, such as paper or heat-sensitive material.

Printer 200 includes print module 210. Print module 210 is the hardware in printer 200 that prints on the printable media to create a document. For example, print module 210 may apply ink to a paper in paper supply unit 205 using a toner. In another example, print module 210 uses thermal-printing techniques by selectively heating portions of a roll of heat-sensitive paper in paper supply unit 205. In another example, print module 210 applies ink to one or more sheets of pre-cut paper in paper supply unit 205.

Documents created in print module 210 exit printer 200 at document tray 215. The documents at document tray 215 may be retrieved by a user or by another device for processing.

Printer 200 includes input/output interface 220. Input/output interface 220 is an interface between printer 200 and any external devices. Input/output interface 220 may be, for example, one or more ports into which a detachable storage device may be received. Input/output interface 220 may also be a connection port into which a computer, point of sale device, cash register, or any other data processing system is connected. For example, printer 200 may be connected to one or more of the components of printer 200 via input/output interface 220.

Data received at input/output interface 220 may be sent to other components of printer 200 and used in the creation of documents. For example, transaction information may be sent to printer 200 at input/output interface 220 from a point of sale device so that a receipt may be printed using a roll of heat-sensitive paper in paper supply unit 205. This data may be buffered or otherwise stored in storage unit 225. Storage unit 225 may be random access memory, a hard drive, or detachment forms of memory.

Printer 200 also includes user interface 230. User interface 230 includes any controls that allow a user to adjust settings for printer 200. For example, user interface 230 may include controls that allow a user to select a type of paper in paper supply unit 205 to be used to create a document. User interface 230 may also include a control, such as a button or knob, which opens the cover of printer 200. The cover may enclose the paper in paper supply unit 205. Alternatively, user interface 230 may be displayed on a graphical user interface of data processing system that is connected to printer 200 via input/output interface 220.

Printer 200 also has exterior 235. Exterior 235 may be any material located at the outer portions of printer 200. For example, exterior 235 may be one or more plastic components that cover the inner components of printer 200. Exterior 235 includes cover 240. Cover 240 may be used to conceal any portion of printer 200 or may provide functionality for printer 200. For example, cover 240 may be a lid that covers paper supply unit 205. Although cover 240 is shown as part of exterior 235, cover 240 may be located anywhere in printer 200, including the inner components of printer 200.

The illustrative embodiments described herein provide an apparatus and method for moving a cover. The apparatus includes a base. A base is any device onto which a cover may be attached. The apparatus also includes a cover pivotably coupled to the base. As used herein, the term "coupled" includes coupling via a separate object. For example, the cover may be coupled to the base if both the cover and the base are coupled to a third object. The term "coupled" also includes "directly coupled," in which case the two objects touch each other in some way. The term "coupled" also encompasses two or more components that are continuous with one another by virtue of each of the components being formed from the same piece of material.

The apparatus in the illustrative embodiments also includes a set of flexible bands. The set of flexible bands includes one or more flexible bands. In one illustrative embodiment, the set of flexible bands are a set of helical springs.

A first end of each of the set of flexible bands is coupled to the cover. In one example, the first end of each of the set of flexible bands is pivotably coupled to the cover at a set of first points. A second end of the set of flexible bands is coupled to the base. In one example, the second end of the set of flexible bands is pivotably coupled to the base at a set of second points. The set of flexible bands are adapted to bias the cover into an open position.

In one illustrative embodiment, the base is a printer, such as a point of sale printer. In this embodiment, the cover may be a printer cover. In one example, the set of flexible bands urge or bias the printer cover into the open position when the printer cover is opened by a user. In another example, the printer cover may be opened by the user using a button on the point of sale printer.

In still another embodiment, the set of flexible bands are elongated when the cover is in the open position. The apparatus may also include a set of buckling members. The set of buckling members includes one or more buckling members. In one embodiment, the set of buckling members prevents straightening of the set of flexible bands when the set of flexible bands are elongated.

Figure 3:
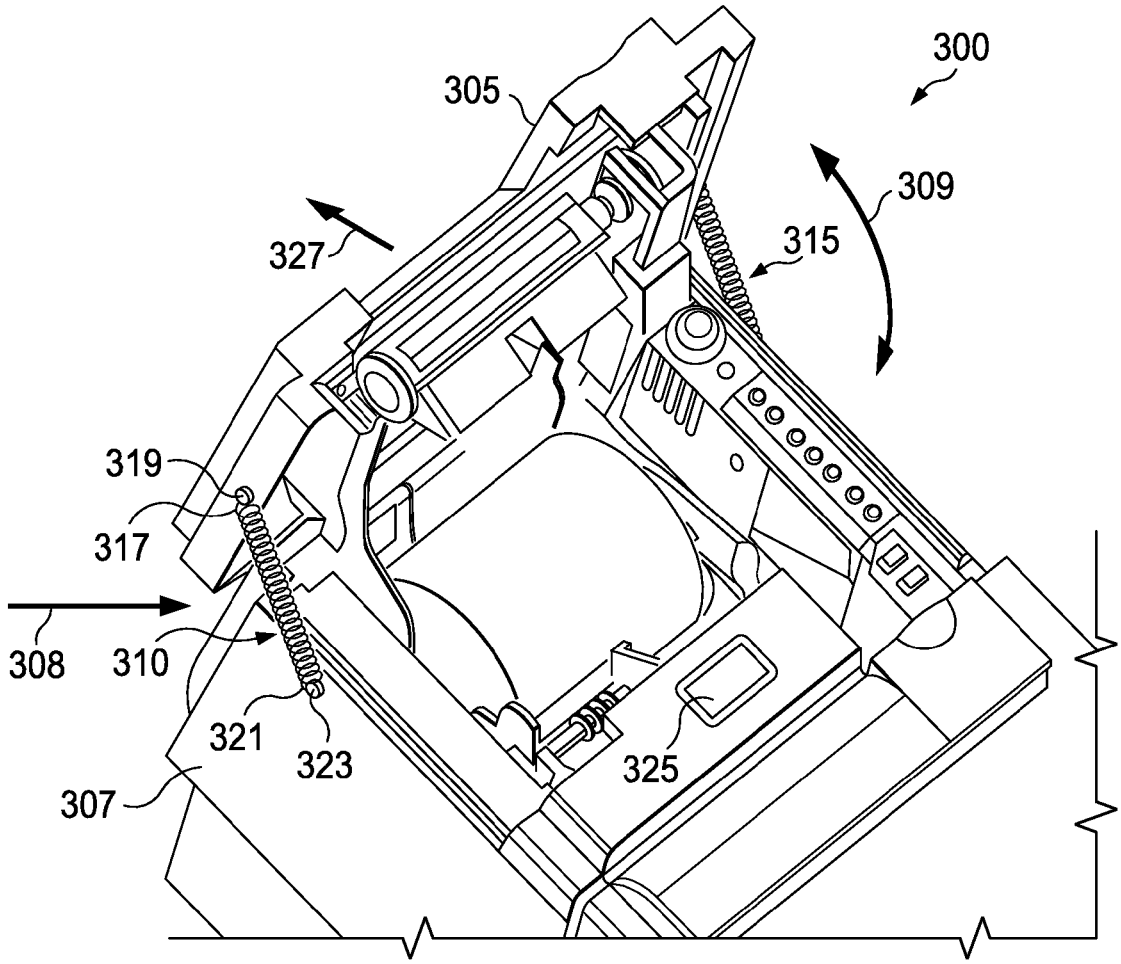
FIG. 3 is an illustration of an apparatus for moving a cover in accordance with an illustrative embodiment.

Turning now to FIG. 3, an illustration of an apparatus for moving a cover is depicted in accordance with an illustrative embodiment. Specifically, FIG. 3 shows printer 300, which includes cover 305 in an open position. Printer 300 is a non-limiting example of printer 115 in FIG. 1 and printer 200 in FIG. 2. In one non-limiting embodiment, printer 300 is a fiscal printer.

Cover 305 is pivotably coupled to printer base 307. The pivotable coupling at which cover 305 is pivotably coupled to printer base 307 is located at the rear of printer 300, as indicated by rear arrow 308. Cover 305 opens and closes by moving in a direction indicated by double arrow 309.

Cover 305 covers a paper supply unit, such as paper supply unit 205 in FIG. 2, in which paper used by printer 300 is stored. However, cover 305 may be used to cover any portion of printer 300, and may provide functionality for printer 300. For example, in FIG. 3, the exterior portion of cover 305 also functions as a document tray, such as document tray 215 in FIG. 2.

Although cover 305 is shown in FIG. 3 to be pivotably coupled to printer base 307 at the rear of printer 300, cover 305 may be coupled to printer base 307 at any location on printer 300. For example, cover 305 may be coupled to printer base 307 at the front, sides, or bottom of printer base 307. Also, cover 305 may be an internal cover that covers internal components of printer 300. In this example, cover 305 may not be visible to a user that is viewing the exterior of printer 300.

Printer 300 includes flexible bands that are coupled to cover 305 and printer base 307. In FIG. 3, these flexible bands are shown as helical springs 310 and 315. Although the flexible bands are shown as helical springs 310 and 315 in FIG. 3, the flexible bands may be any material that exhibits flexibility. For example, the flexible bands may be composed of rubber, plastic, or metal.

In particular, helical springs 310 and 315 may be composed of a variety of materials. For example, helical springs 310 and 315 may be composed of hardened steel, rubber, plastic, non-ferrous metals, or bronze. Any type of metal may be used in helical springs 310 and 315. Other types of springs may also be substituted for helical springs 310 and 315. For example, a conical spring, spiral spring, torsion spring, or gas spring may also be substituted for helical springs 310 and 315.

End 317 of helical spring 310 is pivotably coupled to cover 305 at point 319. Similarly, end 321 of helical spring 310 is pivotably coupled to printer base 307 at point 323. Points 319 and 323 may be located at any point along cover 305 and printer base 307, respectively. Although points 319 and 323 are shown approximately equidistant from the pivot point between cover 305 and printer base 307, points 319 and 323 may be located at respective distances from the pivot point between cover 305 and printer base 307 that are different from one another.

Helical spring 315 is coupled to cover 305 and printer base 307 in a similar manner as helical spring 310, although the points at which helical spring 315 is coupled to cover 305 and printer base 307 are not shown in FIG. 3.

Helical springs 310 and 315 bias or urge cover 305 into an open position. An urge is any exertion of force. In FIG. 3, cover 305 is shown in an open position. When cover 305 is in an open position, helical springs 310 and 315 are elongated. The tendency of helical springs to elongate provides a force that biases cover 305 into an open position. As cover 305 opens, the distance between ends 317 and 321 increases. In a similar manner, as cover 305 opens, the distance between points 319 and 323 increases.

Helical springs 310 and 315 may move cover 305 into an open position upon receiving any indication from a user. An indication is any signal, data, input, or physical stimuli. A non-limiting example of such an indication includes physical contact between cover 305 and the user. In this example, the user may exert an upward force on cover 305. This upward force may have any magnitude.

Another non-limiting example of such an indication includes the pushing of a button on printer 300. In FIG. 3, helical springs 310 and 315 may bias cover 305 into an open position when a user pushes button 325. In one example, the pushing of button 325 may release a latch or other mechanism that keeps cover 305 in a closed position.

While cover 305 is in an open position, a force may be exerted on cover 305 in the direction indicated by arrow 327. Because helical springs 310 and 315 may be stretched in a longitudinal direction, cover 305 may move in the direction indicated by arrow 327 without causing damage to a stopping device or helical springs 310 and 315. Once the force causing the stretching of helical springs 310 and 315 is removed, cover 305 may then return to an original open position, such as the open position illustrated in FIG. 3. Thus, helical springs 310 and 315 may bias cover 305 back into the open position when cover 305 is moved beyond the open position. The force that biases cover 305 back into the open position may be an extension force caused by helical springs 310 and 315 that results from the stretching of helical springs 310 and 315.

Figure 4:
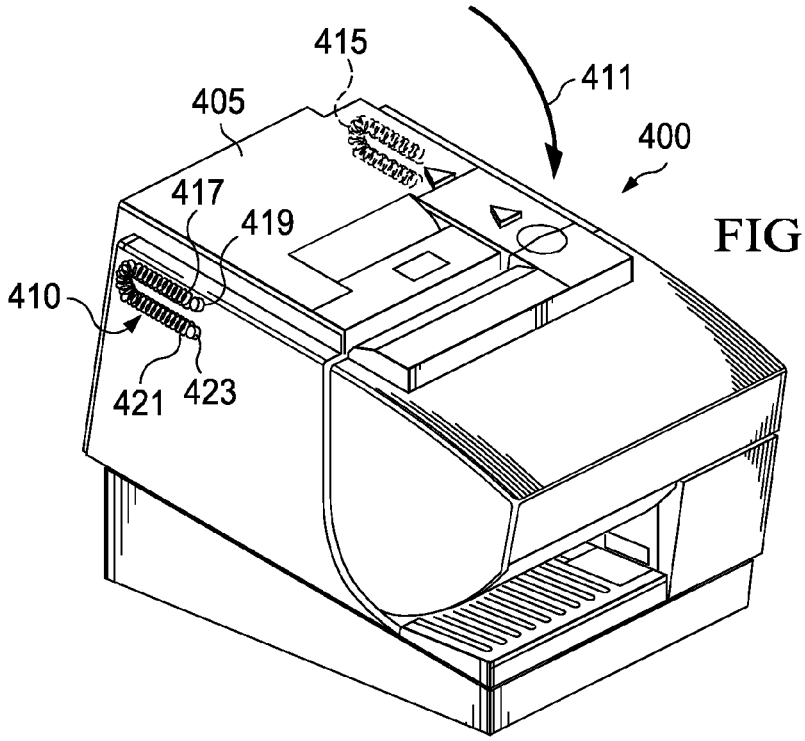
FIG. 4 is an illustration of an apparatus for moving a cover in accordance with an illustrative embodiment.

Turning now to FIG. 4, an illustration of an apparatus for moving a cover is depicted in accordance with an illustrative embodiment. Specifically, FIG. 4 shows printer 400, which includes cover 405 in a closed position. Printer 400 is a non-limiting example of printer 115 in FIG. 1, printer 200 in FIG. 2, and printer 300 in FIG. 3.

In FIG. 4, cover 405 has been moved into a closed position by moving a cover in an open position, such as cover 305 in FIG. 3, in the direction indicated by arrow 411. The distance between ends 417 and 421 of helical spring 410 decreases as cover 405 closes. Similarly, the distance between ends 419 and 423 of helical spring 410 decreases as cover 405 closes.

When cover 405 is in an open position, a resisting force caused by helical springs 410 and 415 resists a closing force along arrow 411. The resisting force may also be called a detent force. This closing force may be caused by any source, such as gravity or a user. The closing force must overcome the resisting force in order for cover 405 to be closed.

The resisting force caused by helical springs 410 and 415 may help to prevent cover 405 from being closed inadvertently. Also, in order for the resisting force to be overcome, some buckling in helical springs 410 and 415 may be required. The buckling of helical springs 410 and 415 will be discussed in greater detail with respect to FIGS. 5 and 6.

Figure 5:
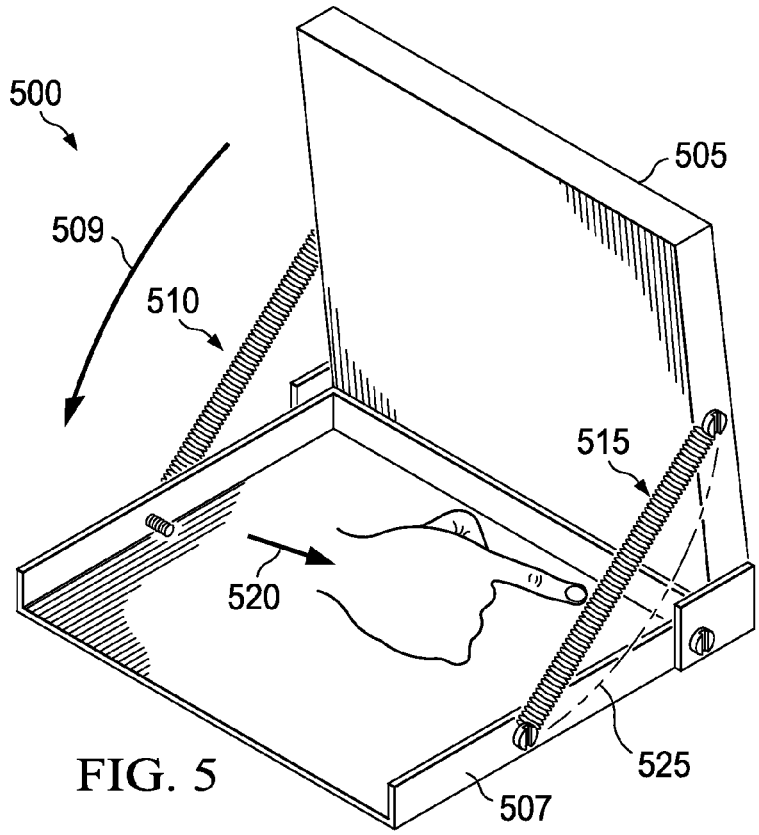
FIG. 5 is an illustration of an apparatus for moving a cover in accordance with an illustrative embodiment.

Turning to FIG. 5, an illustration of an apparatus for moving a cover is depicted in accordance with an illustrative embodiment. Specifically, FIG. 5 shows cover moving system 500, which includes cover 505 and base 507. The cover moving system shown for printers 300 and 400 in FIGS. 3 and 4, respectively, are examples of cover moving system 500. Cover moving system 500 may be used in any device having a pivotable or hingable component. Non-limiting examples of such devices include a printer, automobile, airplane, toy, point of sale devices, laptop, handheld device, or any device with moving parts.

In FIG. 5, cover 505 is shown in an open position. Cover 505 may be closed by moving cover 505 in a direction indicated by arrow 509. As discussed with respect to FIG. 4, a resisting force is caused by helical springs 510 and 515. The resisting force resists the closure of cover 505. The resisting force increases as helical springs 510 and 515 become straighter. The resisting force also maintains cover 505 in an open position.

In one embodiment, due to this resisting force, helical springs 510 and 515 are bent in order to facilitate the closing of cover 505. In FIG. 5, user 520, in closing cover 505 into a closed position, bends helical springs 510 and 515 into a position indicated by bent position indication line 525. In this embodiment, bending either or both of helical springs 510 and 515 may lessen the resisting force maintaining cover 505 in an open position, thereby allowing user 520 to close cover 505.

Figure 6:
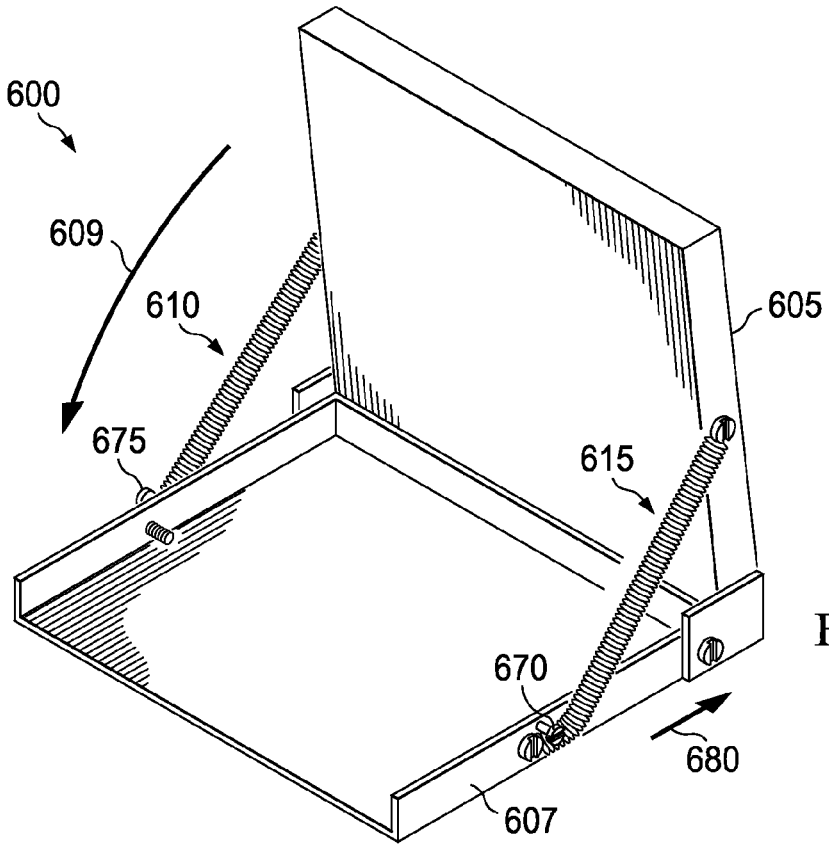
FIG. 6 is an illustration of an apparatus for moving a cover in accordance with an illustrative embodiment.

Turning now to FIG. 6, an illustration of an apparatus for moving a cover is depicted in accordance with an illustrative embodiment. Specifically, FIG. 6 shows cover moving system 600, which includes cover 605 and base 607. Cover moving system 600 is non-limiting example of cover moving system 500 in FIG. 5.

Cover moving system 600 includes buckling members 670 and 675. Buckling members 670 and 675 prevent the straightening of helical springs 610 and 615 when cover 605 is in an open position or when helical springs 610 and 615 are elongated. In one example, buckling members 670 and 675 are coupled to base 607. Bucking member may be made of any material, such as metal, plastic, rubber, wood, or any other material having sufficient rigidity to prevent straightening of helical springs 610 and 615. Also, although buckling members 670 and 675 are shown to have a circular cross-section, buckling members 670 and 675 may have any cross-sectional shape, such as polygonal or elliptical.

In particular, buckling members 670 and 675 provide a bending force that bends helical springs 610 and 615 in a direction indicated by arrow 680. Cover 605 may be closed by moving cover 605 in a direction indicated by arrow 609. A resisting force is caused by helical springs 610 and 615. The resisting force increases as helical springs 610 and 615 become straighter. The resisting force maintains cover 605 in an open position.

The bending force, caused by buckling members 670 and 675, which bends helical springs 610 and 615 in a direction indicated by arrow 680, may lessen the resisting force maintaining cover 605 in an open position. By lessening the resisting force caused by helical springs 610 and 615, the closing of cover 605 by a user is facilitated.

In one embodiment, a force required to close cover 605 into a closed position decreases as a curvature in helical springs 610 and 615 increases. In this embodiment, the curvature is determined by the position of buckling members 670 and 675. For example, as the position of buckling members 670 and 675 moves in the direction indicated by arrow 680, an increased curvature is caused in helical springs 610 and 615.

Figure 7:
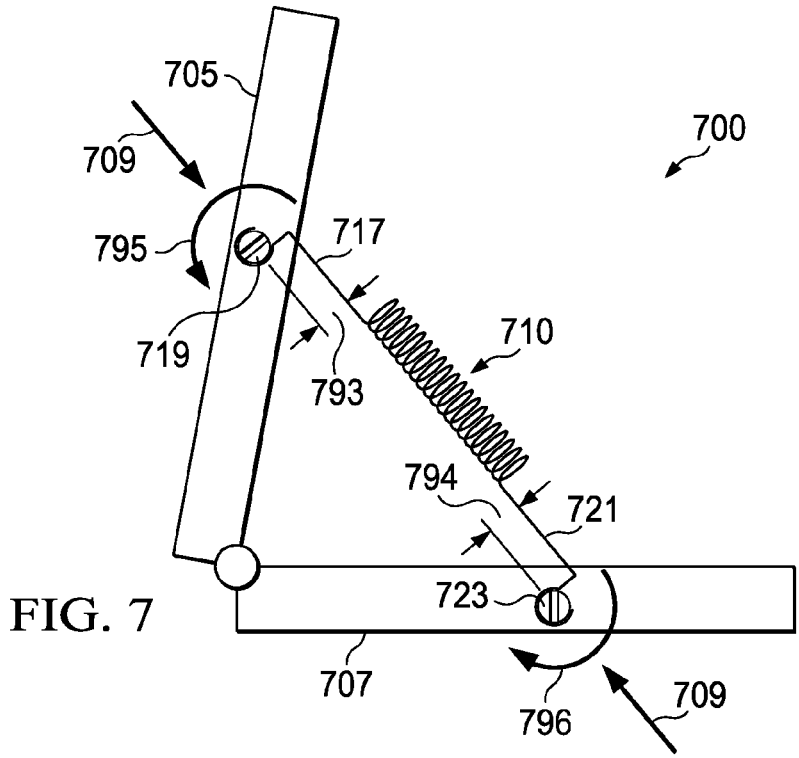
FIG. 7 is an illustration of an apparatus for moving a cover in accordance with an illustrative embodiment.

Turning now to FIG. 7, an illustration of an apparatus for moving a cover is depicted in accordance with an illustrative embodiment. Specifically, FIG. 7 shows cover moving system 700, which is a non-limiting example of cover moving system 600 in FIG. 6.

In cover moving system 700, the longitudinal axis of helical spring 710 is offset from the center of pivot points 719 and 723 by offsets 793 and 794. Helical spring ends 717 and 721 may be springs that are contiguous or part of helical spring 710. Helical spring ends 717 and 721 may also be rigid members that are less flexible than helical spring 710.

Offsetting helical spring ends 717 and 721 causes bending moments 795 and 796 to be applied to helical spring 710 when a closing force is applied to either or both of cover 705 or base 707 in the direction indicated by arrows 709. In FIG. 7, bending moments 795 and 796 occur around pivot points 719 and 723, respectively. Bending moments 795 and 796 may occur even when helical spring 710 is in a straightened position. Bending moments 795 and 796 lessen the resisting force maintaining cover 705 in an open position and facilitates the closure of cover 705 by a user.

Figure 8:
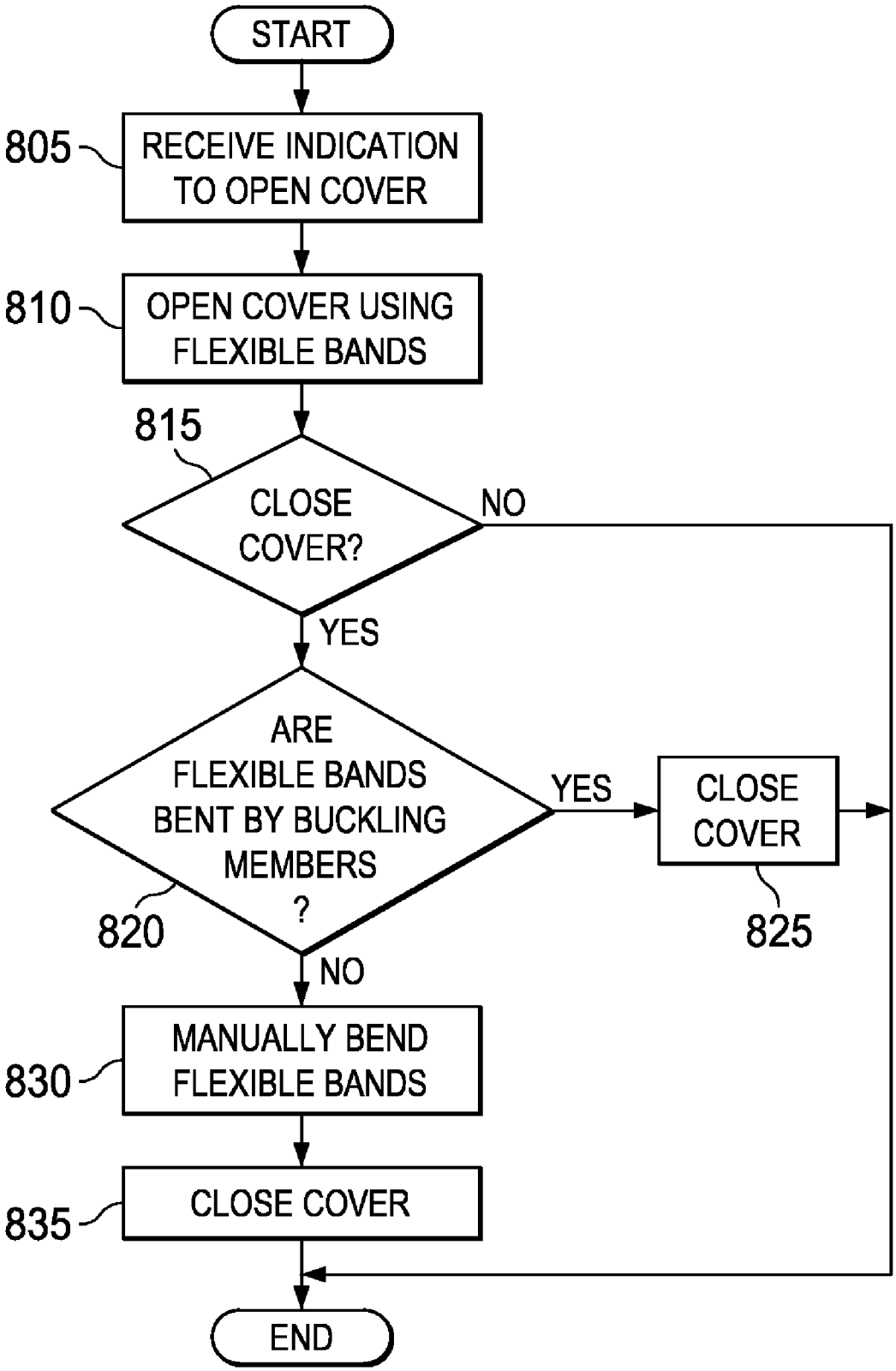
FIG. 8 is a flowchart illustrating a process for moving a cover in accordance with an illustrative embodiment.

Turning now to FIG. 8, a flowchart illustrating a process for moving a cover is depicted in accordance with an illustrative embodiment. The process illustrated in FIG. 8 may be implemented by a cover moving system, such as those shown in FIG. 3 through 7.

The process begins by receiving an indication to open a cover that is coupled to a base (step 805). For example, the indication may be from a user or an external device. The process opens the cover using a set of flexible bands, such as a set of helical springs (step 810).

The process then determines whether to close the cover (step 815). If the process determines not to close the cover, the process then terminates.

If the process determines to close the cover, then the process determines whether the flexible bands, such as the helical springs, are bent by buckling members (step 820). If the process determines that the flexible bands are bent by buckling members, then the cover closes (step 825).

If the process determines that the flexible bands are not bent by buckling members, then the flexible bands are manually bent (step 830). The cover is then closed (step 835). The process then terminates.

The illustrative embodiments described herein provide an apparatus and method for moving a cover. The apparatus includes a base. The apparatus also includes a cover pivotably coupled to the base.

The apparatus also includes a set of flexible bands. In one embodiment, the set of flexible bands are a set of helical springs.

A first end of each of the set of flexible bands is coupled to the cover. In one example, the first end of each of the set of flexible bands is pivotably coupled to the cover at a set of first points. A second end of the set of flexible bands is coupled to the base. In one example, the second end of the set of flexible bands is pivotably coupled to the base at a set of second points. The set of flexible bands are adapted to bias or urge the cover into an open position.

In one embodiment, the base is a printer, such as a point of sale printer. In this embodiment, the cover may be a printer cover. In one example, the set of flexible bands bias or urge the printer cover into the open position when the printer cover is opened by a user. In another example, the printer cover is opened by the user using a button on the point of sale printer.

In another embodiment, the set of flexible bands are elongated when the cover is in the open position. The apparatus may also include a set of buckling members. In one embodiment, the set of buckling members prevents straightening of the set of flexible bands when the set of flexible bands are elongated.

The illustrative embodiments described herein provide a force to open a cover and act as an open limiting mechanism. The illustrative embodiments also provide a detent force that maintains the open position of the cover. The force caused by a set of flexible bands to open the cover may be nearly constant regardless of the position of the cover. The flexible bands are more resilient to wear than traditional lock knee systems, and also offer a cover movement limiting function that reduces or eliminates wear on open limiting mechanisms.

The flowcharts and block diagrams in the different depicted embodiments illustrate the architecture, functionality, and operation of some possible implementations of apparatus and methods. In this regard, each block in the flowchart or block diagrams may represent a module, segment, or portion of code, which comprises one or more executable instructions for implementing the specified function or functions. In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An apparatus comprising:

a base;

a cover pivotably coupled to the base;

a set of flexible bands, wherein a first end of each of the set of flexible bands is coupled to the cover, wherein a second end of the set of flexible bands is coupled to the base, wherein the set of flexible bands are capable of biasing the cover into an open position, and wherein the set of flexible bands are elongated when the cover is in the open position; and a set of buckling members, wherein the set of buckling members prevents straightening of the set of flexible bands when the set of flexible bands are elongated.

2. The apparatus of claim 1, wherein the set of flexible bands are a set of helical springs.

3. The apparatus of claim 1, wherein the base is a printer, and wherein the cover is a printer cover.

4. The apparatus of claim 3, wherein the printer is a point of sale printer.

5. The apparatus of claim 4, wherein the set of flexible bands bias the printer cover into the open position when the printer cover is opened by a user.

6. The apparatus of claim 5, wherein the printer cover is opened by the user using a button on the point of sale printer.

7. The apparatus of claim 1, wherein a force caused by the set of flexible bands that maintains the cover in the open position increases as the set of flexible bands become straighter.

8. The apparatus of claim 1, wherein a force required to close the cover into a closed position decreases as a curvature in the set of flexible bands increases, wherein the curvature is determined by a position of the set of buckling members.

9. The apparatus of claim 1, wherein the first end of each of the set of flexible bands is pivotably coupled to the cover at a set of first points, and wherein the second end of the set of flexible bands is pivotably coupled to the base at a set of second points.

10. The apparatus of claim 9, wherein the set of first points and the set of second points are approximately equidistant from a point at which the cover is pivotably coupled to the base.

11. The apparatus of claim 1, wherein the set of flexible bands bias the cover back into the open position when the cover is moved beyond the open position.

12. A method for moving a cover, comprising:

receiving an indication to open the cover for a printer from the user;

responsive to receiving the indication to open the printer from the user, moving the cover of the printer into an open position using a set of springs, wherein the cover is pivotably coupled to the printer, wherein a first end of each of the set of springs is coupled to the cover, wherein a second end of the set of springs is coupled to a base; and preventing a straightening of the set of springs using a set of buckling members.

13. The method of claim 12, wherein a distance between the first end and the second end increases as the cover opens.

14. The method of claim 12, further comprising:

closing the cover to a closed position, wherein the closing further comprises:

bending the set of springs.

15. The method of claim 14, wherein the bending is performed by the set of buckling members.

16. The method of claim 14, wherein a distance between the first end and the second end decreases as the cover closes.

17. An apparatus for moving a cover, comprising:

a point of sale printer pivotably coupled to the cover;

a set of helical springs, wherein a first end of each of the set of helical springs is pivotably coupled to the cover, wherein a second end of the set of helical springs is pivotably coupled to the point of sale printer, wherein the set of helical springs are capable of biasing the cover into an open position when the cover is opened by a user, and the set of helical springs are elongated when the cover is in the open position; and a set of buckling members, wherein the set of buckling members prevents straightening of the set of helical springs when the set of helical springs are elongated.

* * * * *